US005117665A

United States Patent [19]

Swan et al.

[11] Patent Number: 5,117,665

[45] Date of Patent: Jun. 2, 1992

[54] VEHICLE DOOR LOCK SYSTEM

[76] Inventors: Jye P. Swan, 5121 Creekside Rd., Brunswick Hills, Ohio 44212; Lee S. Weinerman, 5464 Chippewa Rd., Median, Ohio 44256; Joel T. Vargus, 15340 Sprague Rd., Middleburg Heights, Ohio 44130

[21] Appl. No.: 604,346

[22] Filed: Oct. 25, 1990

Related U.S. Application Data

[63] Continuation of Ser. No. 456,048, Dec. 26, 1989, abandoned, which is a continuation of Ser. No. 320,894, Mar. 9, 1989, abandoned, which is a continuation of Ser. No. 222,349, Jul. 20, 1988, abandoned, which is a continuation of Ser. No. 106,934, Oct. 5, 1987, abandoned, which is a continuation of Ser. No. 830,709, Feb. 18, 1986, abandoned.

[51] Int. Cl.[5] ..... E05C 3/34

[52] U.S. Cl. ..... 70/264; 292/48

[58] Field of Search ..... 70/264; 292/45, 48, 292/216, 280, DIG. 25, DIG. 26, DIG. 31, DIG. 2

[56] References Cited

U.S. PATENT DOCUMENTS

| | | | |
|---|---|---|---|
| D. 48,834 | 4/1916 | Sprung . | |
| D. 292,369 | 10/1987 | Greco | D8/331 |
| D. 297,706 | 9/1988 | Falk | D8/331 |
| D. 304,291 | 10/1989 | Weinerman et al. | D8/331 |
| D. 311,323 | 10/1990 | Weinerman et al. | D8/331 |
| D. 311,324 | 10/1990 | Weinerman et al. | D8/344 |
| 616,144 | 12/1898 | Roth . | |
| 1,714,286 | 5/1929 | Waldo . | |
| 1,869,274 | 7/1932 | Phillips . | |
| 2,014,280 | 9/1935 | Ellery . | |
| 2,156,874 | 5/1939 | Schonitzer | 292/216 |
| 2,187,531 | 1/1940 | Butler . | |
| 2,460,961 | 2/1949 | Wilson | 292/48 |
| 2,782,062 | 2/1957 | Smith | 292/216 |
| 2,911,247 | 11/1959 | Corbin | 292/48 |
| 2,916,318 | 12/1959 | Van Voorhees | 292/280 |
| 2,955,865 | 10/1960 | Leslie | 292/280 |
| 2,987,336 | 6/1961 | Kramer | 292/52 |
| 3,002,778 | 10/1961 | Chanaryn et al. | 292/221 |
| 3,066,965 | 12/1962 | Jeavons | 292/224 |
| 3,073,638 | 1/1963 | Chanaryn et al. | 292/226 |
| 3,095,226 | 6/1963 | Chanaryn et al. | 292/221 |

(List continued on next page.)

OTHER PUBLICATIONS

A. E. Merchandising Limited, *Locks, Latches, Handles & Hardware*, Birmingham, England, 1981, (see pp. 32–35 and four layout pages between numbered pp. 16 and 17).

*Primary Examiner*—Richard E. Moore

[57] ABSTRACT

A vehicle door lock system includes, interior and exterior handle assembies that are accessible, respectively, from interior and exterior sides of a vehicle door on which the door lock system is mounted. The door lock system includes a rotary latch that is configured to releasably engage a door-frame-mounted striker to "latch" and "unlatch" the door. The door is "locked" and "unlocked" by selectively enabling and disabling driving connections between the handle assemblies and separate release arms of the rotary latch. More specifically, locking and unlocking of the door are effected either by operating an exterior key cylinder, or by operating an interior sill button. The handle assemblies, the key cylinder and the sill button preferably are commercially available units that are arranged as may be appropriate for use with a particular vehicle door, with these units being interconnected for operation by a novel and highly versatile linkage, with elements of the linkage being operable to interact so that, 1) when the door is "latched" but not "locked," either of the handle assemblies may be operated to unlatch the door, 2) when the door is both "latched" and "locked," neither of the handle assemblies may be operated to unlatch the door, and, 3) such locking and unlocking movements as are executed by the key cylinder will cause corresponding movements of the sill button between its locked and unlocked positions whereby the position of the sill button is operable to provide an indication of the "locked" and "unlocked" status of the door lock system.

15 Claims, 10 Drawing Sheets

U.S. PATENT DOCUMENTS

| | | | |
|---|---|---|---|
| 3,098,671 | 7/1963 | Moss | 292/221 |
| 3,118,703 | 1/1964 | White et al. | 292/221 |
| 3,262,725 | 7/1966 | Ballantyne | 287/189.35 |
| 3,287,048 | 11/1966 | Jeavons | 292/216 |
| 3,312,489 | 4/1967 | Trudeau | 292/48 |
| 3,345,100 | 10/1967 | Kramer | 292/48 |
| 3,378,289 | 4/1968 | Beckman et al. | 292/31 |
| 3,400,961 | 9/1968 | Koch et al. | 292/216 |
| 3,563,589 | 2/1971 | Kwasiborski | 292/216 |
| 3,572,792 | 3/1971 | Foley | 292/216 |
| 3,583,742 | 6/1971 | Kwasiborki | 292/216 |
| 3,592,504 | 7/1971 | Sandor | 296/50 |
| 3,666,307 | 5/1972 | Zaydel | 292/216 |
| 3,844,593 | 10/1974 | Slattery | 292/48 |
| 4,172,768 | 10/1979 | Cerdan | 292/216 |
| 4,312,202 | 1/1982 | Pastva, Jr. et al. | 70/472 |
| 4,320,642 | 3/1982 | Pastva, Jr. | 70/472 |
| 4,363,231 | 12/1982 | Kaveney, Jr. | 70/484 |
| 4,482,265 | 11/1984 | Koza | 403/71 |
| 4,486,042 | 12/1984 | Chee | 292/246 |
| 4,487,441 | 12/1984 | Miyamoto et al. | 292/336.3 |
| 4,489,965 | 12/1984 | Taylor | 292/34 |
| 4,492,395 | 1/1985 | Yamada | 292/216 |
| 4,502,246 | 3/1985 | Minami | 49/322 |
| 4,505,500 | 3/1985 | Utsumi | 292/48 |
| 4,508,378 | 3/1985 | Rochman | 292/333 |
| 4,508,379 | 4/1985 | Mochida | 292/336.3 |
| 4,530,136 | 7/1985 | Konkle | 24/608 |
| 4,538,845 | 9/1985 | Yamada | 292/216 |
| 4,544,189 | 10/1985 | Fiordellisi et al. | 292/50 |
| 4,561,690 | 12/1985 | Shinjo et al. | 296/155 |
| 4,575,138 | 3/1986 | Nakamura et al. | 292/216 |
| 4,580,821 | 4/1986 | Genord, Jr. et al. | 292/336.3 |
| 4,585,261 | 4/1986 | Adams et al. | 292/216 |
| 4,586,737 | 5/1986 | Arlauskas | 292/216 |
| 4,603,894 | 8/1986 | Osenkowski | 292/216 |
| 4,620,736 | 11/1986 | Shanks | 293/116 |
| 4,896,906 | 1/1990 | Weinerman et al. | 292/48 |
| 4,917,412 | 4/1990 | Swan et al. | 292/48 |

VEHICLE DOOR LOCK SYSTEM

This application is a continuation of Ser. No. 07/456,048 filed Dec. 26, 1989 as a continuation of application Ser. No. 320,894 filed Mar. 9, 1989 as a continuation of application Ser. No. 222,349 filed Jul. 20, 1988 as a continuation of application Ser. No. 106,934 filed Oct. 5, 1987 filed as a continuatino of application Ser. No. 830,709 filed Feb. 18, 1986, all entitled VEHICLE DOOR LOCK SYSTEM and all now abandoned.

BACKGROUND OF THE INVENTION

1. Field of the Invention

The present invention relates generally to a door lock system for releasably latching and selectively locking a door of a motor vehicle such as a passenger car, van, truck, motor coach, recreational vehicle or the like. More particularly, the present invention relates to a novel and improved, extremely versatile door-mounted lock system that includes a rotary latch and connection linkage assembly, with the rotary latch being operable to securely but releasably engage a door-frame-mounted striker, and with the connection linkage providing a highly versatile means for connecting the rotary latch with a wide variety of commercially available interior and exterior operating handle assemblies, with a wide range of key cylinder and sill button hardware, and with almost any desired relative mounting arrangement of the rotary latch, the interior and exterior operating handles, and other associated hardware.

2. Prior Art

It is customary to provide a side door of a vehicle such as an automobile, van, truck or the like with a door-carried lock system that is operable, when the door is closed adjacent a door frame that defines a passenger access opening, to "latch" the door as by bringing rotatable components of a rotary latch into surrounding and restraining, but selectively releasable engagement with a door-frame-carried striker.

It is customary, also, to provide a side door of a vehicle with interior and exterior handle assemblies which may be operated to "unlatch" the rotary latch and to thereby permit door movement out of its closed position.

Still further, it is customary to provide a key cylinder in association with the exterior handle assembly, with the key cylinder being operable selectively to "lock" and "unlock" components of the door lock mechanism as by selectively preventing and permitting the exterior door handle assembly from unlatching the door.

Typically, the door lock mechanism of a vehicle side door also can be "locked" and "unlocked" by vertically shifting what is referred to as a "sill button." The sill button usually takes the form of an elongate, interiorly accessible, vertically movable button that has a lower end region which is connected to a control rod that is housed within the structure of a door, and an upper end region that projects through a sill opening that is defined by the door structure at a location near the bottom level of a window opening that is defined by the door structure. Depressing the sill button to its lowermost or "locked" position causes the control rod to set components of the door lock mechanism to a "locked" configuration that will prevent at least the exterior handle assembly from unlatching the door. Raising the button to its uppermost or "unlocked" position causes the control rod to effect unlocking of components of the door lock system components so that operation of the exterior handle assembly will function to unlatch the door.

Moreover, it is known to provide a door lock system of a side door of a vehicle with apparatus for assuring that, when components of the door lock system are locked, the interior handle assembly (in addition to the exterior handle assembly) will be prevented from unlatching the door. This feature of fully disabling the interior handle when a sill button has been depressed (i.e., when the door lock system has been "locked") is particularly desirable for use with vehicles that transport children, the intended purpose being to prevent unwanted opening of a vehicle door as the result of a child's tampering with or operating the interior handle assembly. In the industry, such apparatus as may be provided to disable an interior door handle when a door lock system is "locked" often is referred to by the term "childproofing mechanism."

While vehicle door lock systems of a variety of configurations have been proposed, with many including so-called "childproofing mechanisms," prior proposals typically suffer from one or more drawbacks. One problem has been a lack of versatility of system components that severely limits not only the type, style, shape and/or structural configuration of doors with which a particular locking system proposal can be used, but also limits the relative arrangements of interior and exterior handle assemblies, key cylinder and sill button hardware with which a particular locking system proposal can be used. Moreover, the systems of prior proposals typically require custom made operating handle assemblies and/or other custom components, it being recognized that custom components often are relatively expensive to manufacture.

To the degree that some prior door lock system proposals are adaptable for use with commercially available components such as operating handle assemblies, key cylinder and sill button hardware, the complexity of the resulting door lock systems, and attendant difficulties of assembly and adjustment for proper operation that are encountered in installing the resulting systems often have proven to be undesirable and, in some cases, economically unfeasible.

Accordingly, despite a proliferation of prior door lock system proposals, a need has remained for an improved, highly versatile door lock system including a well proven basic type of rotary latch, and an associated connection linkage assembly, with these components being so arranged and interconnected that they are capable of working in harmony with a wide range of commercially available interior and exterior operating handle assemblies, as well as with commercially available key cylinder and sill button hardware.

SUMMARY OF THE INVENTION

The present invention overcomes the foregoing and other drawbacks of the prior art by providing a novel and improved vehicle door lock system that includes a rotary latch and connection linkage assembly that is sufficiently versatile to permit its use with a wide variety of commercially available interior and exterior operating handle assemblies, as well as with commercially available key cylinder and sill button control hardware, with the connecting linkage including a capability for providing desired safety features, for example, a "childproof" feature that permits an interior operating handle to be selectively enabled and disabled for unlatching the rotary latch so that children cannot open a "locked"

door by tampering with or operating the interior handle.

A significant feature of the preferred practice of the present invention resides in its utilization of a well proven basic type of rotary latch—a rotary latch that has been the subject of a longstanding program of continued development, testing and design improvement, with the basic type of rotary latch unit utilized in preferred practice being one that has proven its acceptability in commercial use. Another feature lies in use that is made in the preferred practice of the present invention of commercially available forms of door lock system hardware including interior and exterior operating handle assemblies, as well as key cylinder and sill button components. Stated in another way, the preferred practice of the present invention has the very significant advantage of not proposing a door lock system that is novel and unique throughout the range of elements that make up the system—rather, the invention, in its preferred practice, draws without reservation on strengths of proven designs and commercially available components which, with minimal cost, provide a highly reliable door lock system.

Another feature of the preferred practice of the present invention resides in providing as a "hub" or "centerpiece" of a door lock system, a novel rotary latch and connection linkage assembly of extremely versatile character that gives the system its capability to draw upon strengths, desired characteristics, and unique features of a host of commercially available door lock operating and control hardware such as commercially available interior and exterior operating handle assemblies, key cylinder and sill button hardware. As will be readily apparent to those skilled in the art, while the detailed description and the drawings that form parts of this document describe and illustrate a preferred embodiment of the invention, the novel rotary latch and connection linkage assembly is well adapted for use with a host of other configurations and arrangements of door lock system hardware, and with door constructions of many types and sizes, whereby the invention has far wider applicability than is specifically described in discussing the preferred embodiment. Unlike many prior proposals, a vehicle door lock system that embodies the preferred practice of the present invention utilizes a rotary latch and connection linkage assembly that is easily adapted for use not only with a wide variety of vehicle door sizes, shapes and structural configurations, but also with a wide variety of relative arrangements of operating and control hardware, whereby commercially available hardware components can be positioned and oriented in almost any desired relative arrangement with respect to a selected position for the rotary latch and connection linkage assembly.

In most preferred practice, a vehicle door lock system of the present invention includes interior and exterior handle assemblies that are accessible, respectively, from interior and exterior sides of a vehicle door on which the door lock system is mounted. The door lock system includes a rotary latch that is configured to releasably engage a door-frame-mounted striker to "latch" and "unlatch" the door. The door is "locked" and "unlocked" by selectively enabling and disabling driving connections between the handle assemblies and separate release arms of the rotary latch. More specifically, locking and unlocking of the door are effected either by operating an exterior key cylinder, or by operating an interior sill button. The handle assemblies, the key cylinder and the sill button preferably are commercially available units that are arranged as may be appropriate for use with a particular vehicle door, with these units being interconnected for operation by a novel and highly versatile linkage, with elements of the linkage being operable to interact so that, 1) when the door is "latched" but not "locked," either of the handle assemblies may be operated to unlatch the door, 2) when the door is both "latched" and "locked," neither of the handle assemblies may be operated to unlatch the door, and, 3) such locking and unlocking movements as are executed by the key cylinder will cause corresponding movements of the sill button between its locked and unlocked positions, whereby the positioning of the sill button serves to provide an indication of the "locked" and "unlocked" status of the door lock system.

Preferably, the connection linkage includes a plurality of interior and exterior operating rods. Selected ones of the interior and exterior operating rods are connected, respectively, to the interior and exterior handle assemblies, and/or to separate interior and exterior release levers that form parts of the rotary latch. The operating rods preferably are biased toward "normal" positions that are associated with "normal," seated or nested positions of movable handles that form elements of the associated interior and exterior handle assemblies. The interior and exterior operating rods are movable with their associated handles to separately operate the interior and exterior release levers of the rotary latch to effect unlatching of the rotary latch.

Preferably, the connection linkage also includes a plurality of interior and exterior control rods. Selected ones of the interior and exterior control rods are connected, respectively, to the interior sill button and to the exterior key cylinder, for movement by the sill button and by the key cylinder, respectively, to operate locking components of the door lock system that selectively permit and prohibit unlatching movement of the release levers of the rotary latch in response to operation of the interior and exterior handles.

In the most preferred practice of the present invention, a feature of the connection linkage is that, at one location, namely that of the connection linkage unit (which forms a sub-assembly of the rotary latch and connection linkage assembly), a plurality of pivotally mounted levers which extend in overlying relationship are interconnected in a novel and compact manner. The pivoted array of interconnected levers serves, in turn, to interconnect a plurality of operating and control rods.

Indeed, in the preferred embodiment of the invention that is described and depicted herein, a compact pivoted lever array serves to interconnect not only an opposed pair of operating rods, but also an opposed pair of control rods. The opposed control rods are, in fact, what have been referred to previously as the "interior and exterior control rods," which is to say that one of these control rods connects with the interior sill button, and the other with the exterior lock cylinder. The opposed operating rods are, in fact, segments of what has been referred to previously as the "interior operating rod," which is to say that the operating rod which connects the interior operating handle assembly with the interior release arm of the rotary latch is formed from segments that are selectively drivingly connected by the pivoted lever array.

By virtue of the presence and function of the pivoted lever array, the opposed control rods (i.e., the interior and exterior control rods) are operable, in response to locking and unlocking movements of the sill button and/or the key cylinder, to selectively enable and disable a driving connection between the opposed segments of the interior operating rod, whereby the opposed interior and exterior control rods cooperate with the pivoted lever array to enable and disable the interior operating handle assembly when the door is "unlocked" and "locked," respectively. But in significant addition to this "childproofing" function, the pivoted lever array causes the opposed control rods to cooperate with elements of the exterior operating handle assembly to assure that unlocking and locking movements of the external key cylinder are always reflected by corresponding raised or lowered positionings of the sill button, whereas locking and unlocking movements of the sill button are caused to disable and enable both of the interior and exterior operating handle assemblies.

Thus, in preferred practice, the connection linkage unit performs far more than the function of what has come to be referred to as a "childproofing mechanism." Indeed, the connection linkage unit serves, within a very compact and centrally located area that is adjacent to the rotary latch unit, to provide a multiplicity of functions, with as many as two pairs of operating and control rods connecting with the pivoted lever array, and with the pivoted lever array cooperating with other components of the door lock system to perform many of the interrelated functions of the door lock system that traditionally have required much more complex, space consuming, non-centralized assemblies to execute.

Moreover, because a compact pivoted lever array is employed at a location that is adjacent to the rotary latch unit to perform so many of the key functions of the door lock system, the versatility of the combined rotary latch and connection linkage assembly is enhanced, for operating and control rods can be arranged to extend in substantially any needed direction relative to the pivoted lever array to suitably connect the pivotal lever array with any of a wide variety of door lock operating and control hardware, and with such hardware being arranged and oriented as may be most preferred to accommodate a vehicle door of almost any desired size, shape and structural configuration.

BRIEF DESCRIPTION OF THE DRAWINGS

The foregoing and other advantages, and a fuller understanding of the invention that is described and claimed in the present application may be had by referring to the following description and claims taken in conjunction with the accompanying drawings wherein:

DESCRIPTION OF THE PREFERRED EMBODIMENT

Figure 1:
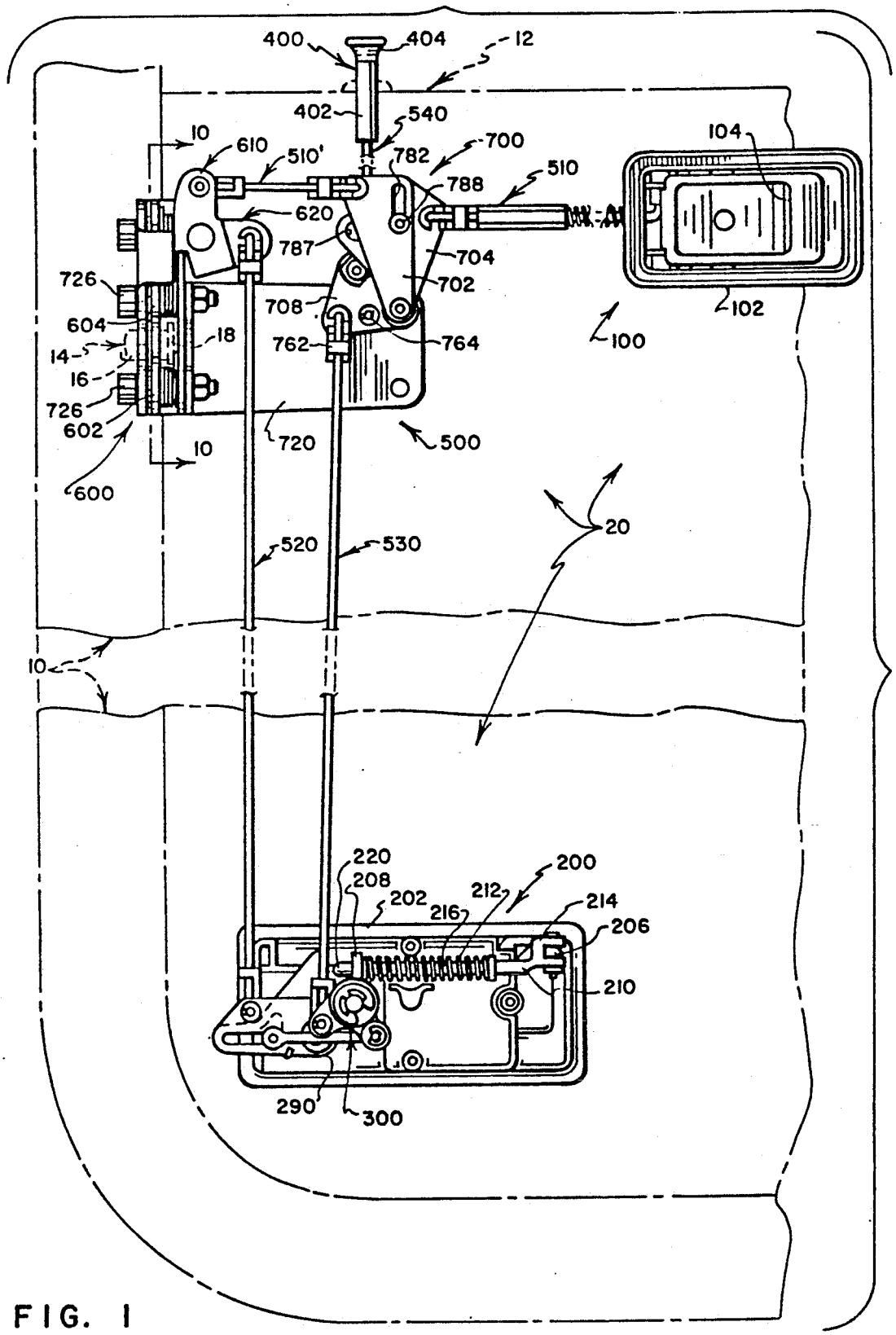
FIG. 1 a side elevational view of a vehicle door lock system as viewed from an interior of a side door of a vehicle on which the system is mounted, with the door and portions of a door-frame-carried striker being shown in phantom, with portions of the door and the door lock system foreshortened, and with components of the door lock system being depicted in their "latched" and "locked" configuration.

Referring to FIGS. 1-6, portions of a side door of a vehicle are indicated generally by the numeral 10 and are shown in phantom. The door 10 has a window sill that is designated by the numeral 12. Also shown in phantom in FIGS. 1-5 are portions of an elongate, cantilevered striker pin 14 that is mounted on door frame portions (not shown) of the vehicle which extend adjacent to the door 10 when the door 10 is closed. The striker 14 has a generally cylindrical central portion 16 that is shown in cross section in FIGS. 10-12, and a hex formation 18 at its distal end.

Figure 2:
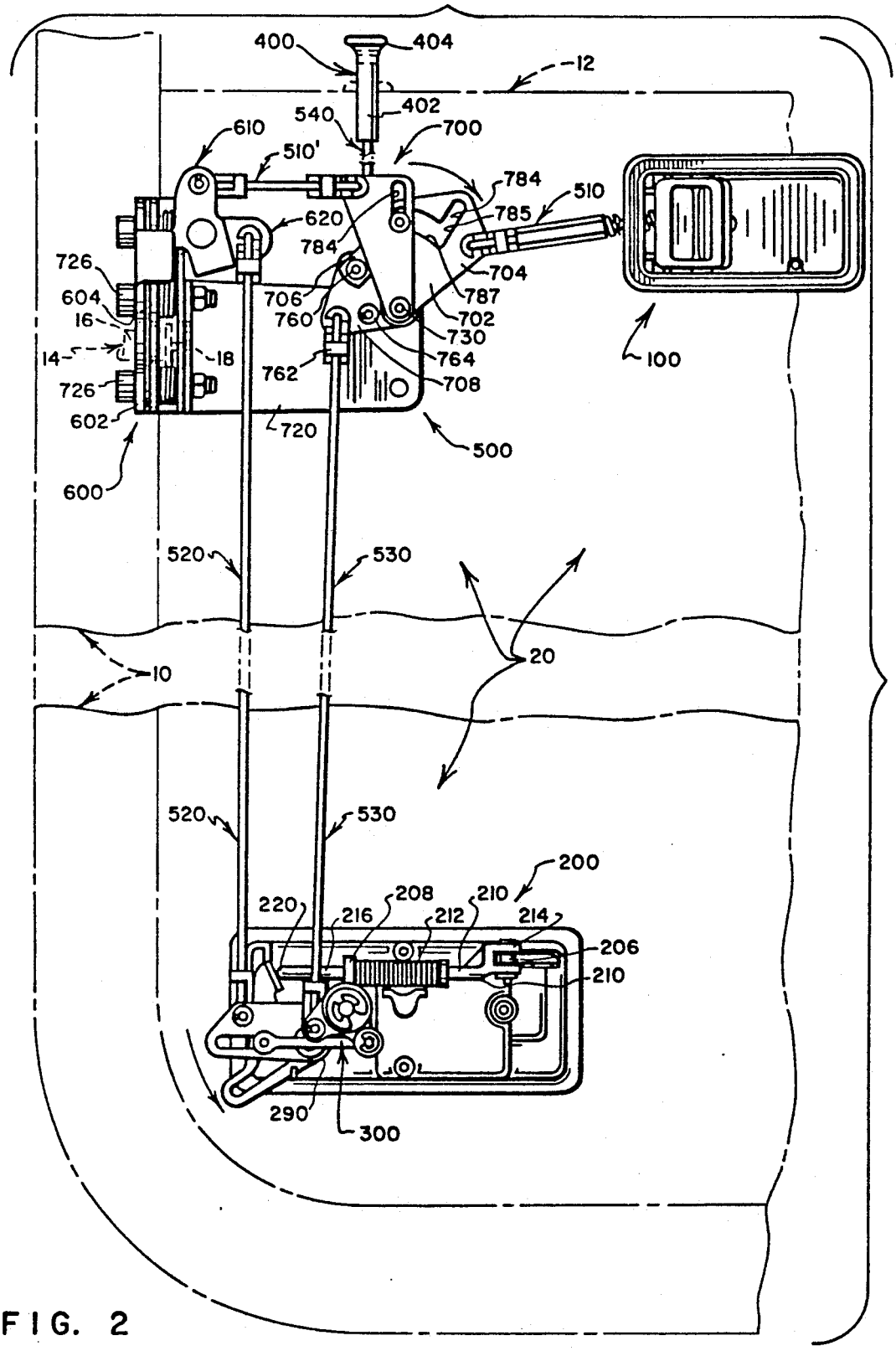
FIG. 2 is a side elevational view similar to FIG. 1, but with both an interior handle assembly and an exterior handle assembly of the door lock system being actuated while the system is "locked," whereby a feature of the door lock system is illustrated, namely that when the system is "locked," neither of the handle assemblies are operative to "unlatch" the door.
Figure 3:
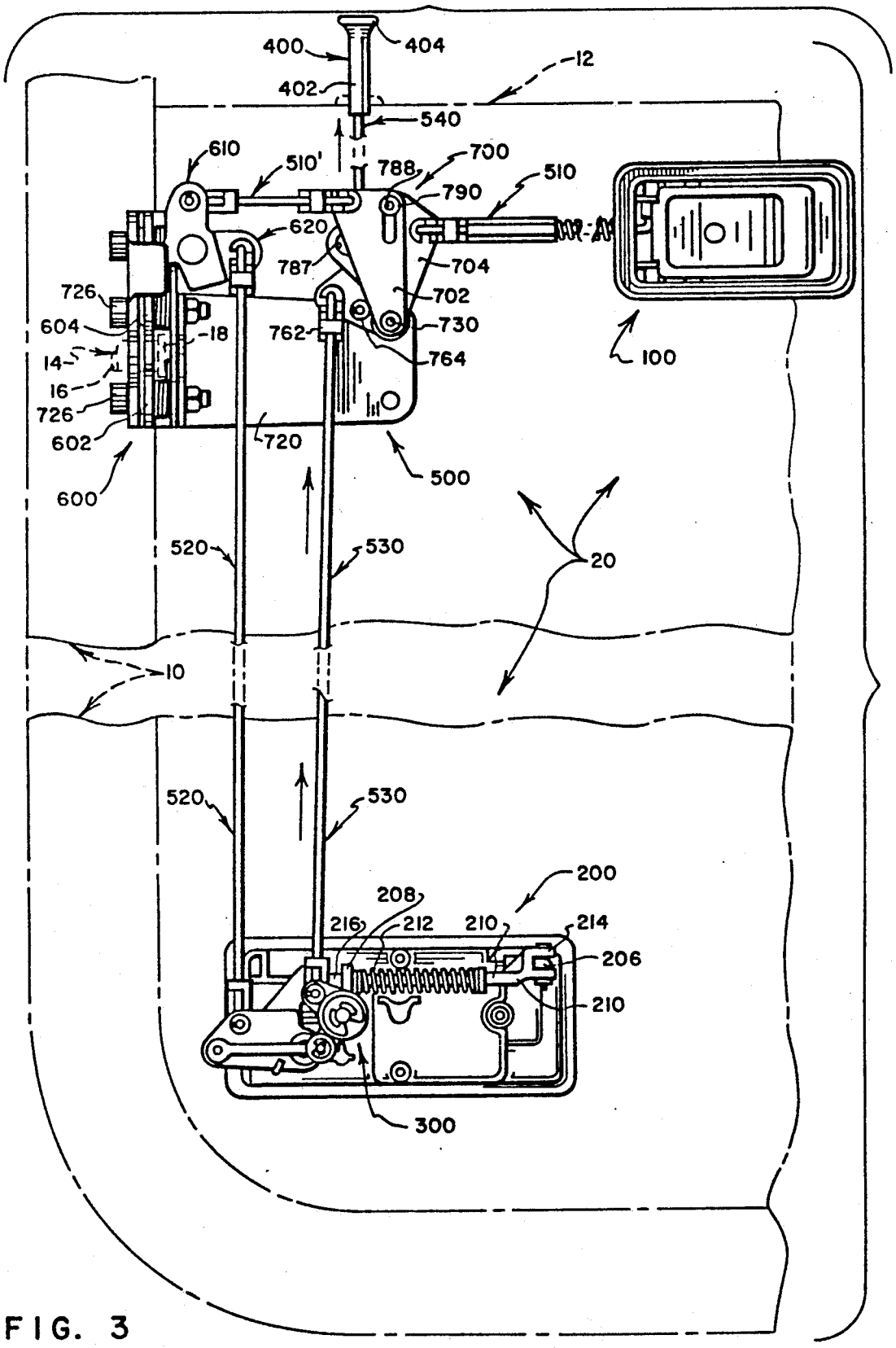
FIG. 3 is a side elevational view similar to FIG. 1, but with components of the door lock system in their "latched" and "unlocked" configuration.
Figure 4:
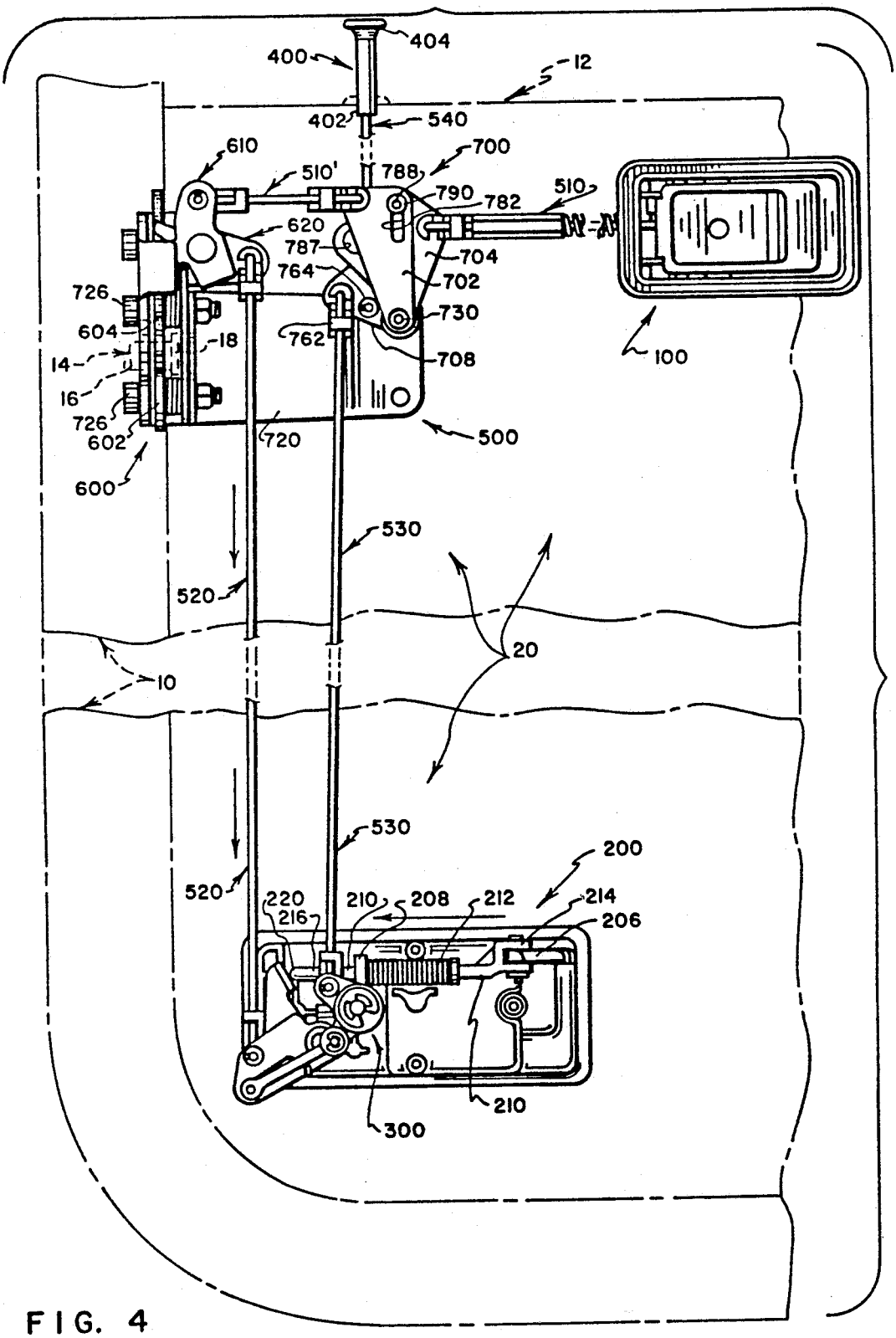
FIG. 4 is a side elevational view similar to FIG. 3, but with an exterior handle assembly of the door lock system being operated while the system is "unlocked," whereby the rotary latch of the door lock system is "unlatched" to release the striker, this view also illustrating that operation of the exterior handle assembly does not cause corresponding operation of the interior handle assembly.
Figure 5:
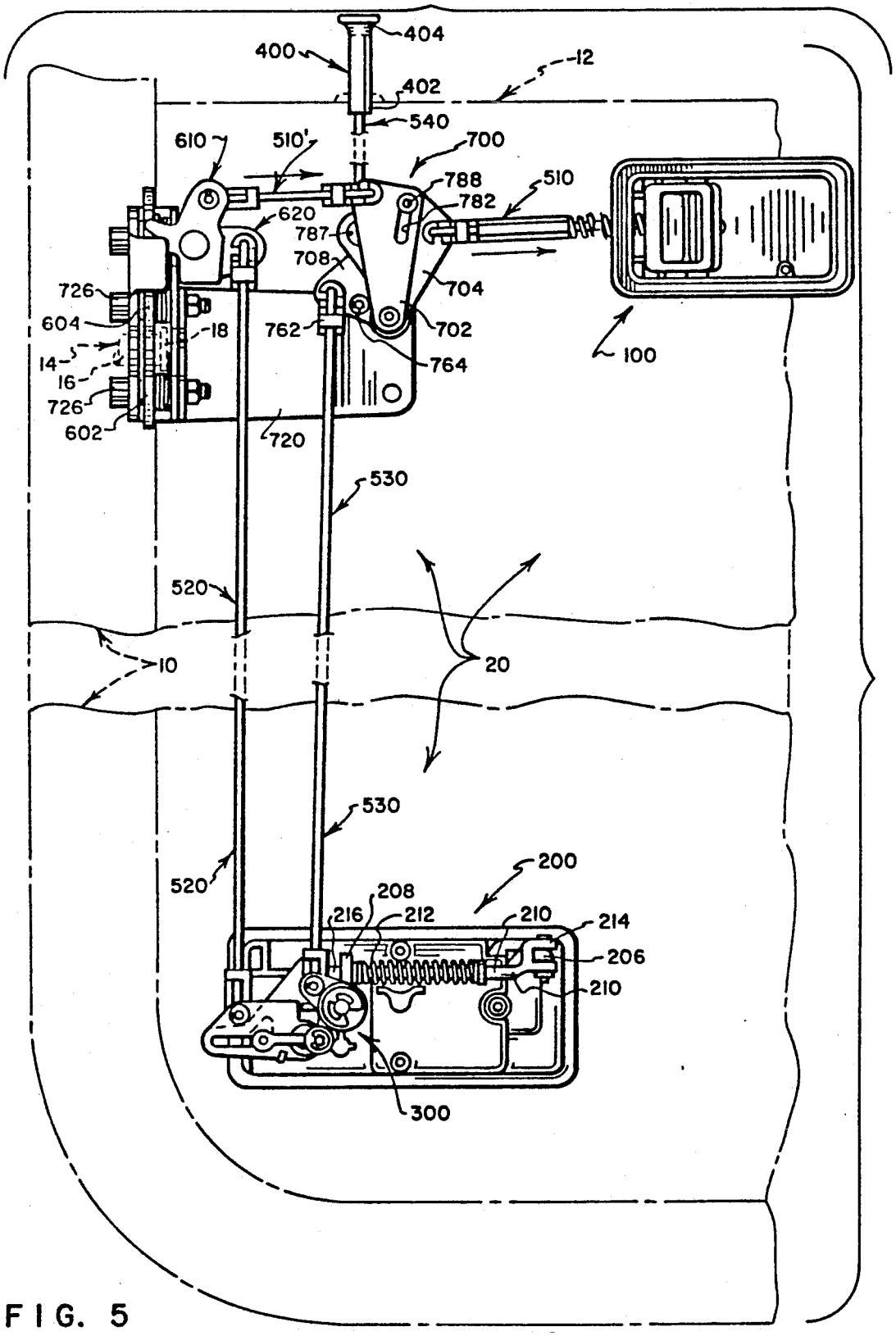
FIG. 5 is a side elevational view similar to FIG. 3, but with the interior handle assembly being operated while the system is "unlocked," whereby the rotary latch is "unlatched" to release the striker, this view also illustrating that operation of the interior handle assembly does not cause corresponding operation of the exterior handle assembly.
Figure 6:
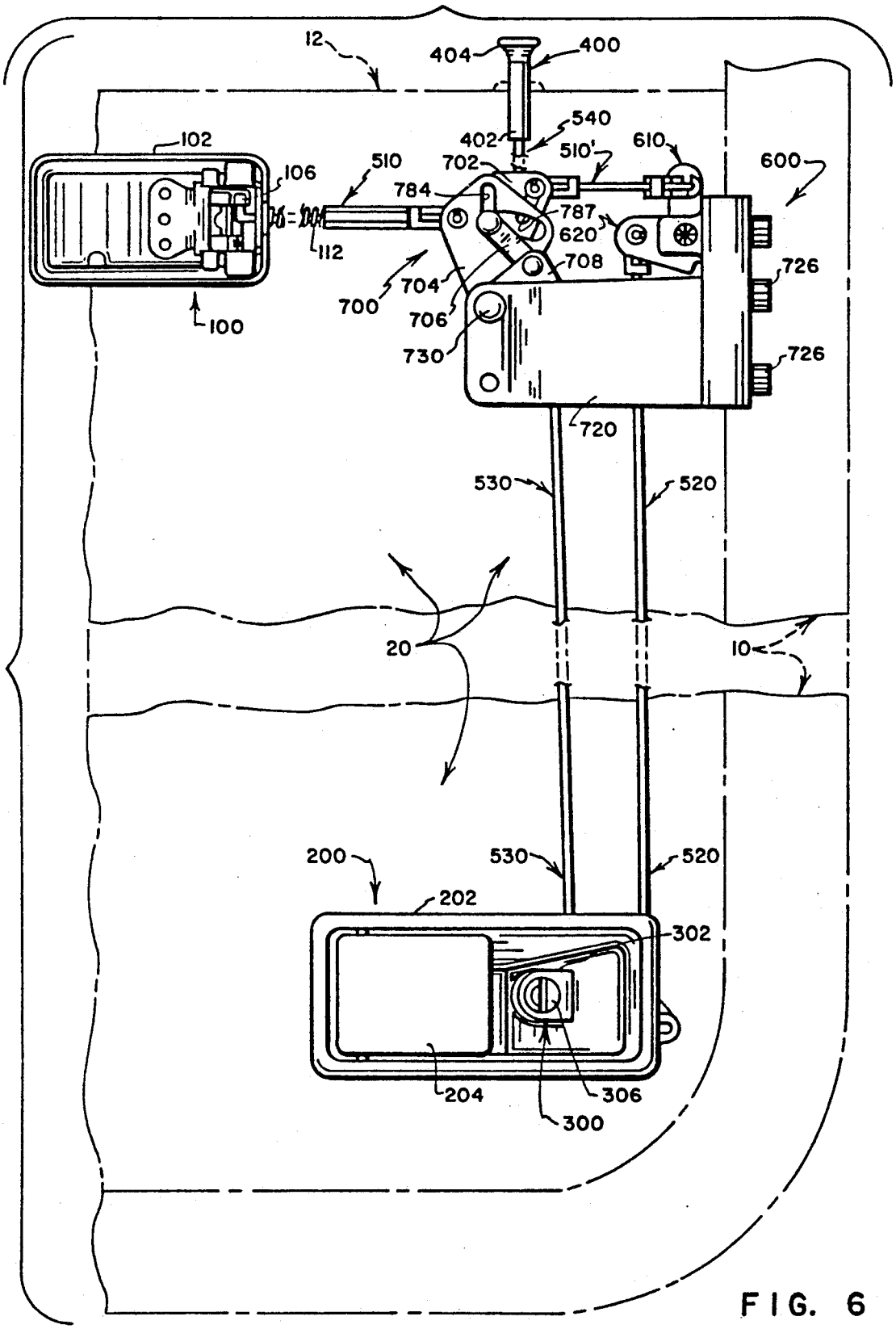
FIG. 6 is a side elevational view from an exterior side of the door, with components of the door lock system oriented as depicted in FIG. 1 so that the door is both "latch and "locked;"

A vehicle door lock system that embodies the preferred practice of the present invention is indicated generally by the numeral 20. FIGS. 1-5 depict components of the door lock system 20 as viewed from an interior side of the door 10. FIG. 6 depicts components of the door lock system 20 as viewed from an exterior side of the door 10. In FIGS. 1, 2 and 6, the door 10 is "locked," with components of the door lock system 20 in "latched" engagement with the striker 14. In FIG. 3 the door 10 is "unlocked" but "latched." FIGS. 4 and 5 show the door 10 "unlocked" and "unlatched."

The door lock system 20 incorporates several commercially available components including an interior operating handle assembly 100, an exterior operating handle assembly 200, an exterior key cylinder assembly 300 (that typically is sold as a part of the exterior handle assembly 200), and an interior sill button 400. The door lock system 20 also includes a rotary latch and connection linkage assembly which is indicated generally by the numeral 500. The latch and linkage assembly 500 interconnects the components 100, 200, 300, and 400 as will be described.

Features of the latch and linkage assembly 500 resides in its compact construction, its capability to be located substantially centrally (or otherwise as may be desired) with respect to other components of the door lock system 10, and hence its versatility. As will be apparent from the detailed description that follows, the latch and linkage assembly 500 may be utilized not only with a wide variety of commercially available door lock system components such as the interior and exterior operating handle assemblies 100, 200 and the key cylinder and sill button hardware 300, 400, but also in conjunction with a wide variety of arrangements of these and/or other door lock system components, and with a wide variety of vehicle door sizes, shapes and structural configurations.

The features and operation of the latch and linkage assembly 500 are most easily understood if the assembly 500 is thought of as comprising basically two sub-assemblies that, at times, operate substantially independently, and, at other times, operate in close coordination with each other. These sub-assemblies include what will be referred to as a "rotary latch unit" that is designated in FIGS. 1–6 and 8 by the numeral 600, and a "connection linkage unit" that is designated in FIGS. 1–6 and 9 by the numeral 700.

The rotary latch unit 600 serves to selectively grasp and release the striker 14 to "latch" and "unlatch" the door 10. The unit 600 has a pair of interior and exterior release levers 610, 620, either of which may be operated to initiate unlatching of a pair of rotary latch bolts 602, 604. The rotary latch bolts 602, 604 are shown in "latched" engagement with a cylindrical center portion 16 of the striker 14 in FIG. 10, and are shown in their "unlatched" position in FIG. 12. Likewise, FIGS. 1–3 and 6 show the rotary latch unit 600 "latched," while FIGS. 4 and 5 show the exterior and interior handle assemblies 200, 100, respectively, operated to "unlatch" the rotary latch unit 600.

Figure 9:
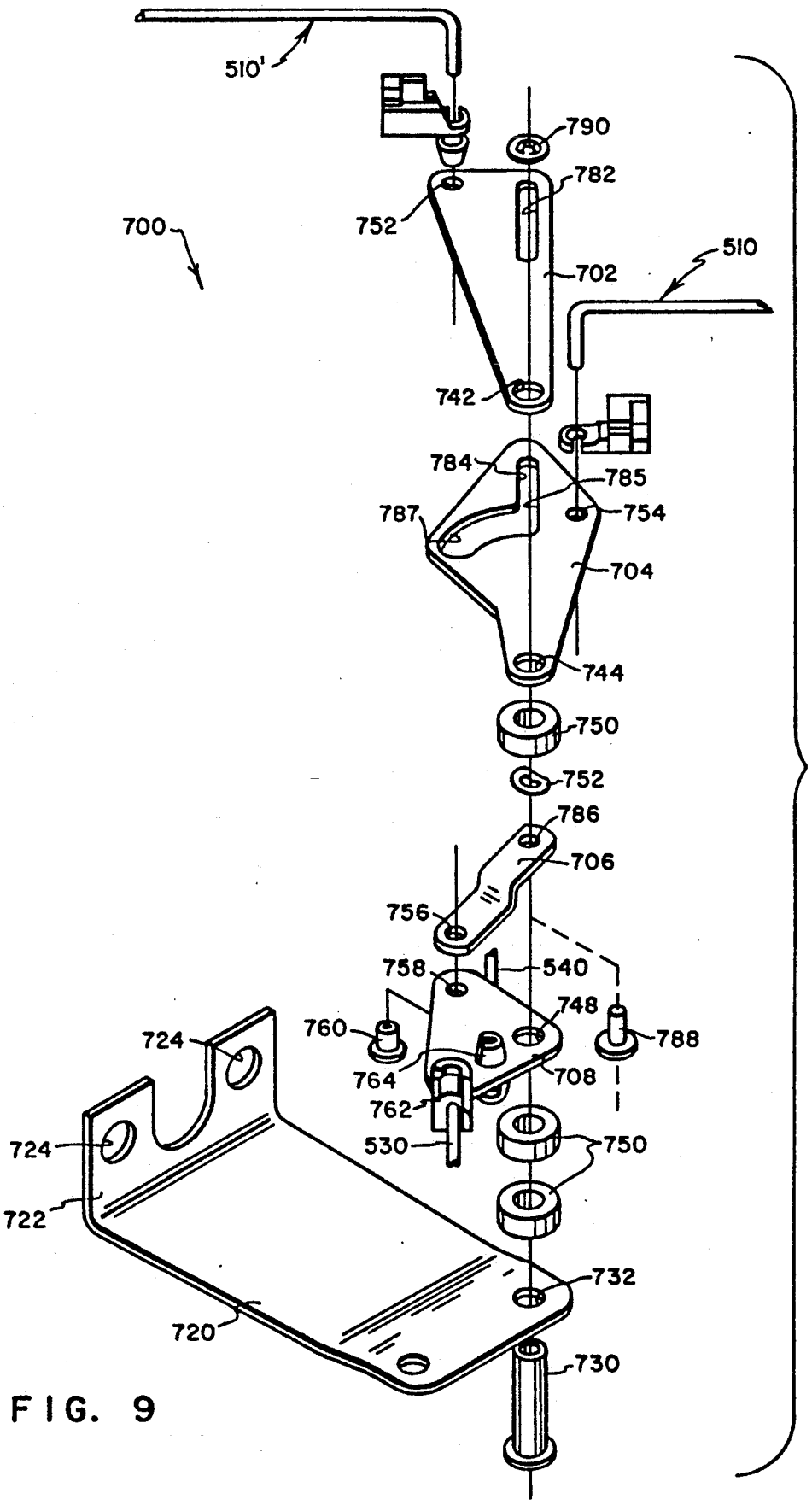

The connection linkage unit 700 includes a plurality of translatable operating rods, control rods and pivotally mounted levers. Referring to FIG. 9, a feature of the connection linkage unit 700 lies in its provision of a compact array of overlying, pivotally mounted levers 702, 704, 706, 708 that connect with opposed operating rods 510, 510', and with opposed control rods 530, 540. As will be explained, the control rods 530, 540 operate to enable and disable the interior operating handle assemblies 100, 200 for operating the interior and exterior release levers 610, 620. The operating rods 510, 510' are segments of an interior operating rod structure that transmits forces through the connecting lever unit 700 to operate the interior release lever 610 of the rotary latch unit 600 in response to operation of the interior handle assembly 100, but only when the door 10 is unlocked "Referring to FIGS. 1–6, the connection linkage also includes a separate exterior operating rod 520 that connects the exterior operating handle assembly 200 with the exterior release lever 620 for unlatching the rotary latch unit 600 in response to operation of the exterior handle assembly 200, but only when the door 10 is "unlocked."

In operation, and as will be explained in greater detail, the elements mentioned above cooperate to assure that: 1) when the door 10 is "latched" but not "locked," either of the handle assemblies 100, 200 may be operated to unlatch the door 10; 2) when the door 10 is both "latched" and "locked," neither of the handle assemblies 100, 200 may be operated to unlatch the door 10; and, 3) such locking and unlocking movements as are executed by the key cylinder 300 will cause corresponding movements of the sill button 400 between its locked and unlocked positions, whereby the positioning of the sill button 400 is operative to provide an indication of the "locked" and "unlocked" status of the door lock system 20.

Turning now to a more detailed discussion of the components of the door lock system 20, and referring particularly to FIGS. 1 and 6, the interior operating handle assembly 100 is of a commercially available type sold by Eberhard Manufacturing Company, Cleveland, Ohio 44136, under the model designation 1-29908. A substantially identical unit also is available from A. E. Merchandising Limited, Kings Norton, Birmingham B30 3AR, England, under the same model designation, namely 1-29908. While the construction and arrangement of components of the commercially available interior handle assembly 100 form no part of the present invention, a brief description of selected features thereof will be provided here in order to enable the reader to better understand and appreciate how the rotary latch and connection linkage assembly 500 serve to accommodate and enhance characteristics of the interior operating handle assembly 100.

The interior handle assembly 100 includes a housing 102 which is preferably formed from metal or plastics material as a cast or molded structure of a desired thickness. An operating handle 104 is pivotally mounted on the housing 102 for movement between a "normal" seated or nested position (as depicted in FIGS. 1, 3, 4 and 6) to an operating position (as depicted in FIGS. 2 and 5). Referring to FIG. 6, an arm 106 projects rearwardly with respect to the housing 102. The arm 106 is an integral projecting part of the handle 104 (which does not appear in FIG. 6), and therefore moves with the handle 104 when the handle 104 is pivoted relative to the housing 102.

The operating rod 510 has one end region that is pivotally connected to the arm 106 to couple the operating rod 510 to the handle 104 for movement in response to pivotal movement of the handle 104 with respect to the housing 102. A compression coil spring 112 surrounds a portion of the operating rod 510 and engages a portion of the handle assembly 100 for biasing the operating rod 510 in a direction that tends to bias the handle 104 toward its seated or nested position, i.e., away from its operating position, whereby the handle 104 tends to remain seated or nested with respect to the housing 102.

The exterior operating handle assembly 200 is of a commercially available type sold by Eberhard Manufacturing Company, Cleveland, Ohio 44136, under the model designations 1-25653 and 1-25654 (for left and right hand units, respectively). Substantially identical units also are available from A. E. Merchandising Limited, Kings Norton, Birmingham B30 3AR, England, under the same model designations, namely 1-25653 and 1-25654 (for left and right hand units, respectively). While the construction and arrangement of components of the commercially available exterior handle assembly 200 form no part of the present invention, a brief description of selected features thereof will be provided here in order to enable the reader to better understand and appreciate how the rotary latch and connection linkage assembly 500 serve to accommodate and enhance various characteristics of the exterior operating handle assembly 200.

Figure 7:
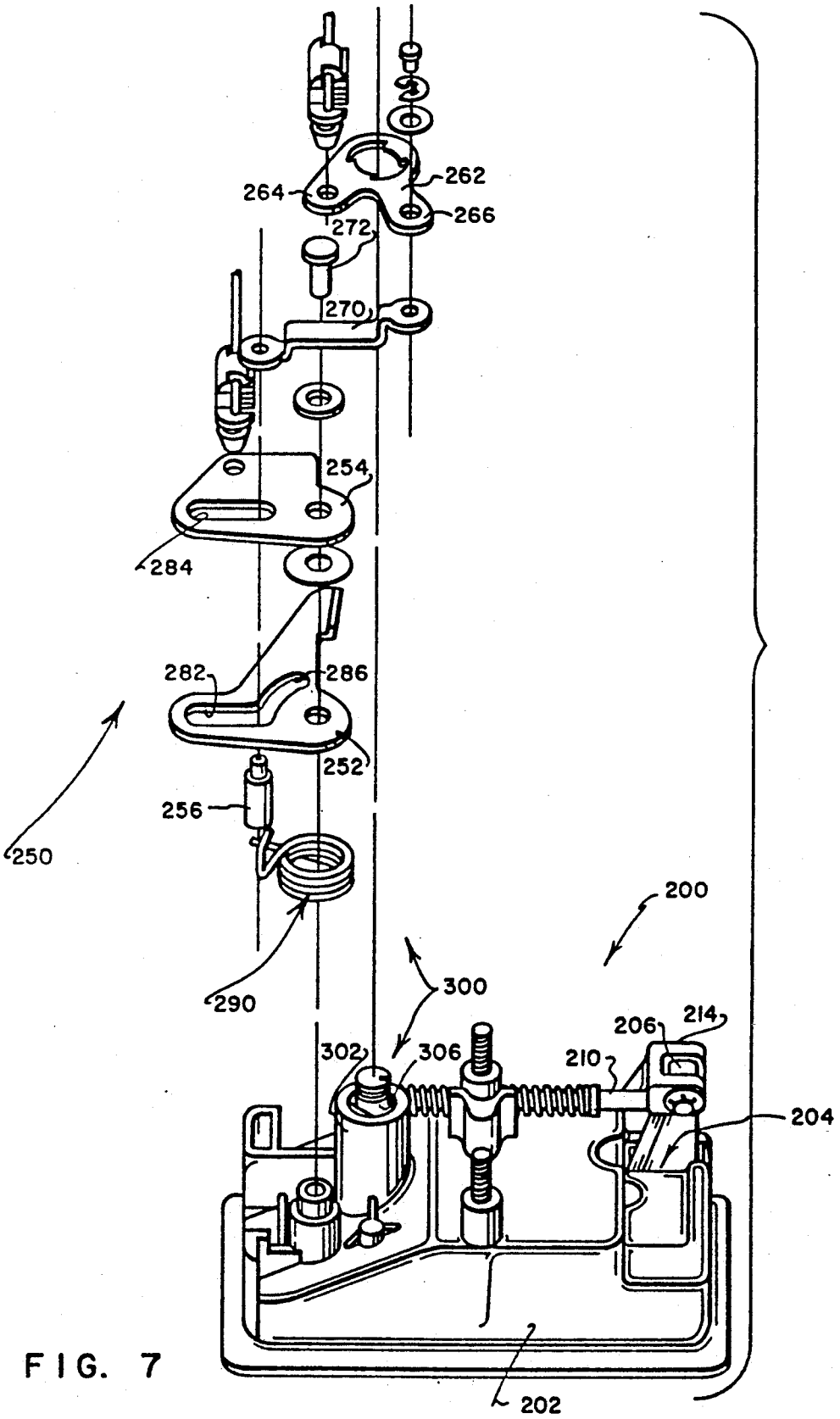
FIG. 7 is an exploded perspective view of selected components of the exterior operating handle assembly and an associated key cylinder assembly.

Referring primarily to FIG. 7 in conjunction with FIGS. 1-6, the exterior operating handle assembly 200 includes a housing 202 which is preferably formed from metal or plastics material as a cast or molded structure of desired thickness. Referring to FIG. 6, an operating handle 204 is pivotally mounted on the housing 202 for movement between a "normal" seated or nested position (as depicted in FIGS. 1, 3 and 5-6) to an operating position (see FIGS. 2 and 4). Referring to FIG. 7, the handle 204 has an arm portion 206 that projects rearwardly with respect to the housing 202. A primary operating rod 210 of elongate configuration has one end region 214 that is pivotally connected to the arm portion 206. Referring to FIGS. 1-5, an opposite end region 216 of the primary operating rod 210 projects through a hole formed in a rearwardly projecting housing formation 208 to mount the rod 210 on the housing 202 for translation in response to pivotal movement of the handle 204 with respect to the housing 202. The rod 210 has an end that defines a rounded engagement surface 220.

A compression coil spring 212 surrounds a central portion of the operating rod 210 and engages the housing projection 208. The spring 212 biases the operating rod 210 in a direction that tends to bias the handle 204 in a direction toward its seated or nested position, i.e., away from its operating position, whereby the handle 204 tends to remain seated or nested with respect to the housing 202.

Referring to FIG. 7, an assembly 250 of relatively movable components is provided on the back of the housing 202 for selectively drivingly connecting the primary operating rod 210 to the external operating rod 520, and for interconnection with the exterior key lock cylinder 300. The assembly 250 includes primary and secondary operating levers 252, 254 that cooperate with a connecting pin 256 to transfer motion from the primary operating rod 210 to the exterior operating rod 520, as will be explained. However, before further describing the components of the assembly 250 and their interconnecting functions, features of the exterior key lock cylinder assembly 300 will be discussed.

Referring to FIGS. 6 and 7, the exterior key lock cylinder assembly 300 preferably is of a type that has a cylinder housing 302 which is formed as an integral part of the housing 202 of the exterior operating handle assembly 200. The assembly 300 has a key-receiving cylinder plug 306 that is journaled by the cylinder housing 302. While the type of key lock assembly 300 that is depicted in the drawings is sold as an integral subassembly of the exterior operating handle assembly 200, it will be understood that substitute or similar forms of key cylinder assemblies may be selected for use from any of a wide variety of commercially available units. Typically, such units have internally carried tumblers (not shown) or other suitable locking structure with common basic characteristics 1) that will permit the cylinder plug 306 to be rotated with respect to the housing 302 only in response to insertion into the plug 306 and rotation therewith of an appropriately configured key (not shown); 2) that define a single relative orientation of the plug 306 and the housing 302 that must be achieved before the key 308 can be removed from the plug 306; and, 3) that permit the plug 306 to be rotated through a range of movement extending through about seventy five degrees of rotation in either of two directions as measured from the orientation of the plug 306 relative to the housing 302 wherein key removal from the plug 306 is permitted.

Referring to FIGS. 1-5 and 7, a feature of the key lock cylinder assembly 300 is that the rotatable plug 306 is drivingly connected to an L-shaped crank arm 262 which can be thought of as comprising an element of the assembly 250. The crank arm 262 has one leg 264 which connects with the exterior control rod 530, and another leg 266 that is connected by a link 270 to the connecting pin 256. The connecting pin 256 serves to provide or prohibit a driving connection between the primary and secondary operating levers 252, 254. A mounting pin 272 pivotally connects the levers 252, 254 to the housing 202.

The levers 252, 254 have overlying radially extending slots 282, 284 formed therein that permit the connecting pin 256 to move from a connecting position shown in FIGS. 3, 4 and 5 to a disconnecting position shown in FIGS. 1, 2 and 6. The primary operating lever 252 has an arcuate slot portion 286 that connects with the inner end region of its radially extending slot 282, wherein the connecting pin 256 can move freely without causing a driving connection to be established between the levers 252, 254 when the connecting pin 256 is caused to be positioned by the link 270 in its disconnecting position, as is shown in FIG. 2 where operation of the external operating handle assembly 200 is shown to have no influence on the external operating rod 520 that would tend to move the exterior release arm 620 to unlatch the latch unit 600.

While the entire exterior operating handle assembly 200 as shown in FIG. 7 is a commercially available unit (for which substantially equivalent and alternate forms of handle assemblies can be substituted as may be preferred) that therefore need not be described in detail, one further feature will be discussed, namely the provision of a multipurpose torsion coil spring 290 that is interposed between the housing 202 and the levers 252, 254 to bias the levers 252, 254 in a clockwise direction as viewed in FIGS. 1-5, and to thereby bias the external operating rod 520 in an upward direction. This feature helps to retain the external operating rod 520 from sliding downwardly when the interior operating handle assembly 100 operates the interior latch release arm 610, whereby the external latch release arm 620 is no longer caused to be biased in a direction that would tend to cause the external operating rod 520 to remain in its upward position. This feature (namely the provision of the torsion coil spring 290) is desirable from the viewpoint that it helps to keep such components as the levers 252, 254 and the external operating rod 520 from becoming loose and being subject to vibration.

Referring to FIGS. 1-6, the interior sill button 400 is of a commercially available type sold by Eberhard Manufacturing Company, Cleveland, Ohio 44136, under the model designation 7-26668. A substantially identical unit is also available from A. E. Merchandising Limited, Kings Norton, Birmingham B30 3AR, England, under the same model designation, namely 7-26668. While the construction and arrangement of the commercially available interior sill button 400 forms no part of the present invention, a brief description thereof will be provided here in order to enable the reader to better understand and appreciate how the rotary latch and connection linkage assembly 500 accommodates and utilizes the button 400 to in conjunction with other components of the door lock system 20.

The interior sill button 400 is an elongate one-piece member that preferably is formed from rigid plastics material. The sill button 400 has a hollow lower end region 402 that is press-fit or threaded onto the operating rod 540, and an enlarged upper end region 404 that projects above the window sill 12 for actuation by an operator's hand. When the sill button 400 is depressed, as is shown in FIGS. 1, 2 and 6, the door lock 10 is "locked" such that attempted operation of either of the handle assemblies 100, 200 will be ineffectual (as is illustrated in FIG. 2) to effect unlatching of either of the release levers 610, 620 of the rotary latch unit 600. When the sill button 400 is raised, as is shown in FIGS. 3–5, the door lock 10 is "unlocked" so that operation of either of the handle assemblies 100, 200 will be operative to unlatch the rotary latch unit 600 as by operating either of the release levers 610, 620, as is shown in FIGS. 4 and 5.

A feature of the connection linkage unit 700 with which the interior control rod 540 connects is that locking and unlocking movements of the sill button 400 are transmitted through the unit 700 to the control rod 530. Stated in another way, when the sill button 400 is raised or lowered, corresponding vertical movements are transmitted from the control rod 540 through the assembly 700 to the control rod 530 to set elements of the exterior handle operating assembly 200 so that the exterior operating assembly will be properly enabled and disabled for operating the exterior latch release arm 620.

A feature of the elements of the exterior handle operating assembly 200 is that locking and unlocking movements of the key cylinder 300 (which sets elements of the exterior handle operating assembly 200 to enable and disable the exterior handle assembly 200 from moving the exterior operating rod 520) cause corresponding vertical movements of the exterior control rod 530 which, in turn, causes the unit 700 to selectively provide and prevent establishment of a driving connection between the operating rod segments 510, 510'; and, likewise, causes the interior control rod 540 to raise or lower to position the sill button 400 so that the position of the sill button 400 is indicative of the "locked" or "unlocked" condition of the door lock system 10 (i.e., a raised sill button 400 indicates that the system 10 is "unlocked," while a lowered sill button 400 indicates that the system 10 is "locked").

Referring to FIG. 9, the connection linkage unit 700 includes an L-shaped support bracket 720 that has a mounting leg 722 with holes 724 through which suitable fasteners such as bolts 726 (shown in FIGS. 1–6) are inserted for attaching the bracket 720 to the housing of the rotary latch unit 600. A rivet 730 is installed through a hole 732 formed in a support leg 734 of the bracket 720. The rivet 730 extends through aligned holes 742, 744, 748 that are formed in the levers 702, 704, 708, and through numerous bushings 750 and a wave spring washer 752 that serve to properly space the levers 742, 744, 748.

The operating rods 510', 510 have end regions that extend through holes 752, 754 formed through the levers 702, 704, respectively. Slots 782, 784 are formed through the levers 702, 704. A hole 786 is formed through the lever 706. A connecting pin 788 extends through the slots 782, 784 and through the hole 786, and is secured by a locking washer 790 to interconnect the levers 702, 704, 706. The slot 782 is elongate, extending radially with respect to the pivotal mounting hole 742 of the lever 702. The slot 784 has an elongate portion 785 that extends radially with respect to the pivotal mounting hole 744 of the lever 704, and has an arcuate portion 787 that extends along a portion of the circumference of an imaginary circle that has as its center the hole 744. By this arrangement, the connecting pin 788 is operable to drivingly connect the levers 702, 704 (and hence to drivingly connect the operating rod segments 510, 510' that are connected to the levers 702, 704) when the pin 788 is positioned in the radially extending portions of the slots 782, 784, but provides no driving connection between the levers 702, 704 when the pin 788 is in the curved portion 787 of the slot 784, whereby the levers 702, 704 are permitted to rotate about the axis of the rivet 730 so that no driving connection is established between the operating rod segments 510, 510' that are connected to the levers 702, 704.

Aligned holes 756, 758 are formed through the levers 706, 708, and a rivet 760 extends through the holes 756, 758 to pivotally interconnect the levers 706, 708. Connectors 762, 764 are provided for connecting the control rods 530, 540 to spaced holes that are formed through the lever 708. By this arrangement, movement of either of the control rods 530, 540 will cause rotation of the lever 708 to rotate about the axis of the rivet 730, whereby motion will be transmitted between the control rods 530, 540. Moreover, motion of either of the control rods 530, 540 will cause movement of the lever 708 to operate the lever 706 to move the connecting pin 788 radially with respect to the slots 782, 784 (as guided by the radially extending slot 782) to provide or prevent establishment of a driving connection between the levers 702, 704 that will either drivingly connect or disconnect the operating rod segments 510, 510'. Thus it will be seen that the unit 700 provides a means for the control rods 530, 540 (which connect, respectively, with the exterior key lock cylinder 300 and the interior sill button 400) to enable and disable the provision of a driving connection between the operating rod segments 510, 510' (and hence between the interior operating handle assembly 100 and the interior latch release lever 610).

Figure 8:
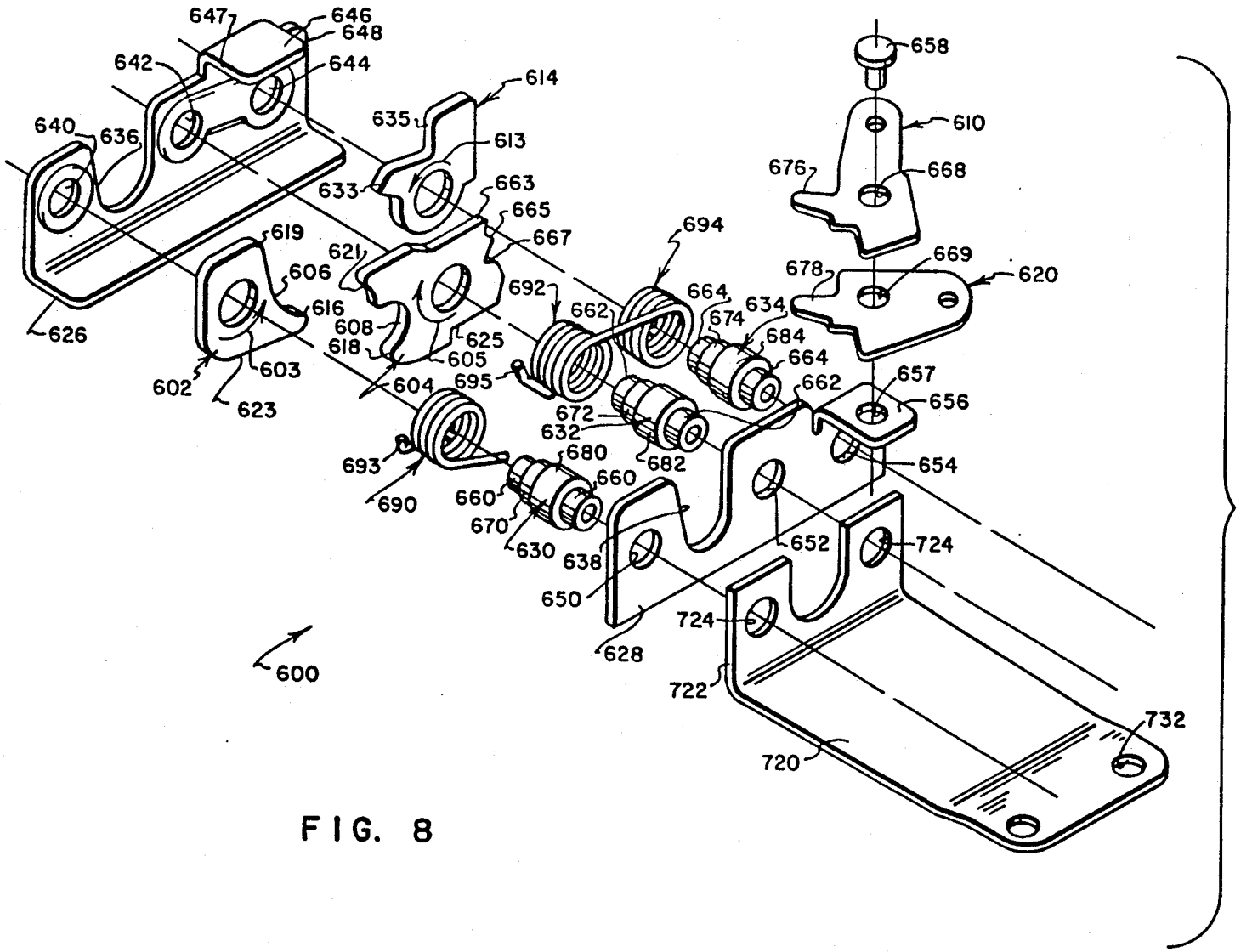
FIGS. 8 and 9 are exploded perspective views, on an enlarged scale, of selected components of two sub-assemblies of a rotary latch and connection linkage assembly of the door lock system, with FIG. 8 principally illustrating components of a sub-assembly that will be referred to as a "rotary latch unit," and with FIG. 9 principally illustrating components of a sub-assembly that will be .referred to as a "connection linkage unit;"
Figure 10:
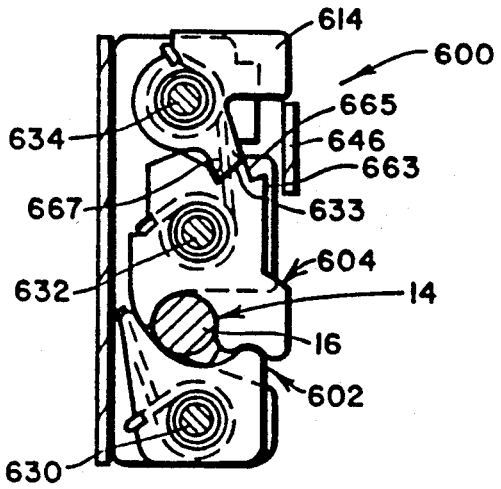
FIG. 10 is a somewhat schematic end elevational view, as viewed substantially from a plane indicated by a line 10—10 in FIG. 1, depicting components of the rotary latch unit in their "latched" configuration surrounding and restraining the striker.
Figure 11:
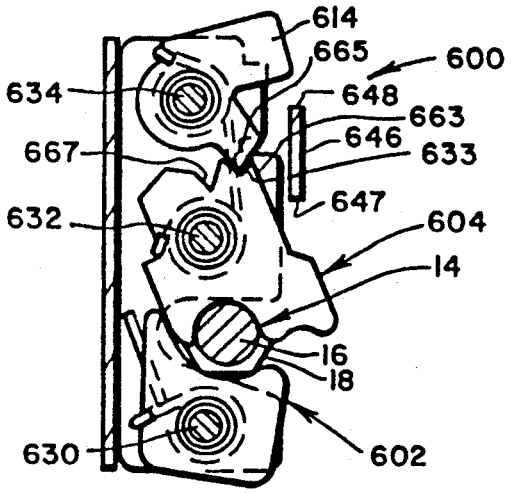
FIG. 11 is a view similar to FIG. 10 but depicting components of the rotary latch unit in a configuration that is intermediate their "latched" and "unlatched" positions, but, nonetheless, engaging and restraining the striker; and, FIG. 12 is a view similar to FIGS. 10 and 11, but depicting components of the rotary latch unit in their "unlatched" configuration, with the striker being released as during opening or closing of the door.
Figure 12:
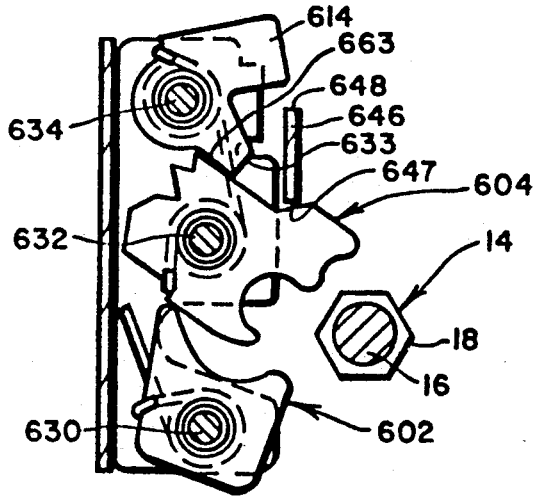

Referring principally to FIG. 8 in conjunction with FIGS. 10–12, the rotary latch unit 600 has a housing which is formed as an assembly of two side plates 626, 628 and three bushings 630, 632, 634. The bushings 630, 632, 634 extend through aligned holes 640, 642, 644 and 650, 652, 654 that are formed in the side plates 626, 628. Reduced diameter end regions 660, 662, 664 of the bushings 630, 632, 634 are crimped (not shown) into engagement with the side wall plates 626, 628 to form a rigidly assembled housing. The bushings 630, 632, 634 have a stepped central regions with a relatively small diameter portion 670, 672, 674 and a relatively large diameter portion 680, 682, 684.

The rotary latch bolts 602, 604 and the pawl 614 are pivotally mounted on the small diameter portions 670, 672, 674, respectively, for rotary movement between fully latched positions shown in FIG. 10, and unlatched positions shown in FIG. 12. Intermediate "preliminary" latching positions of these members are illustrated in FIG. 11.

Torsion spring coils 690, 692, 694 are reeved around the large diameter portions 680, 682, 684 of the bushings 630, 632, 634 to bias the rotary latch bolts 602, 604 and the pawl 614 in directions that are indicated, respectively, by arrows 603, 605 and 613 in FIG. 8.

Aligned notches 636, 638 are formed in the side plates 626, 628. The notches 636, 638 are of such size and configuration as will permit the central portion 16 of the striker 14 to be relatively loosely received therein.

An inwardly turned tab 646 is formed integrally with the side plate 626. A pair of abutment surfaces 647, 648 are defined on opposite sides of the inwardly turned tab 646. An outwardly turned tab 656 is formed as an integral part of the side plate 628. A hole 657 is formed through the tab 656. A rivet 658 extends through the hole 657 and through aligned holes 668, 669 that are formed in the release levers 610, 620 to pivotally mount the release levers 610, 620 on the latch unit 600. Release projections 676, 678 are formed on the levers 610, 620 for engaging the pawl 614 to move it to release its retaining engagement with the rotary latch bolt 604 and to thereby release or "unlatch" the latch bolts 602, 604 for movement to their unlatched position under the influence of the torsion coils 690, 692, as will be explained.

Referring to FIGS. 10-12 in conjunction with FIG. 8, the rotary latch bolt members 602, 604 are provided with concave recesses 606, 608, stop formations 616, 618, cam surfaces 619, 621, and spring end engagement surfaces 623, 625. The recesses 606, 608 are operable to receive the striker 14 as the door 10 is moved toward its closed position. The stop formations 616, 618 engage each other as the door 10 reaches its closed position, thereby preventing further rotation of the latch bolts 602, 604 in a latching direction of movement. The cam surfaces 619, 621 are configured to cooperate with each other to facilitate concurrent movement of the latch bolt members 602, 604 between their latched and unlatched positions. The spring end engagement surfaces 623, 625 engage spring end portions 693, 695 which project from the spring coil portions 690, 692.

A plurality of abutment formations 663, 665, 667 are provided on one side of the latch bolt 604. The pawl 614 has a tooth formation 633 which is selectively engageable with the abutment formations 663, 665, 667. The pawl 614 has a projection 635 which may be engaged by the abutment surface 648 on the tab 646 and by the release levers 610, 620. The pawl 614 is biased by the coil spring portion 694 toward positions which will bring the tooth 633 into engagement with one of the abutment formations 663, 665, 667.

The operation of the rotary latch unit 600 is best understood by referring to the sequence of positions illustrated in FIGS. 10-12. In FIG. 12, the unlatched position of the rotary latch bolts 602, 604 and of the pawl member 614 are shown. In this position, the pawl tooth 633 engages the abutment formation 663. Beginning with the members 602, 604, 614 positioned as shown in FIG. 12, when the door 10 is moved toward the striker 14, the striker pin 14 moves into the side wall notches 636, 638 and into the recesses latch bolt recesses 606, 608. As the striker 14 continues to move inwardly with respect to the notches 636, 638, the rotary latch bolts 602, 604 are rotated toward the intermediate position shown in FIG. 11. As soon as the latch bolt members 602, 604 reach the intermediate position shown in FIG. 11, the pawl tooth 633 pivots under the influence of the coil spring portion 694 into engagement with the abutment formation 665. Continued inward movement of the striker 14 into the notches 636, 638 causes the rotary latch bolts 602, 604 to further rotate toward their latched positions as shown in FIG. 10. As soon as the rotary latch bolt members 602, 604 are in their latched positions, the stop formations 616, 618 engage each other to prevent further latching rotation of the latch bolt members 602, 604, and the pawl tooth 633 engages the abutment formation 667 thereby releasably retaining the rotary latch bolts 602, 604 in their latched positions.

In order to open the door 10, one of the interior and exterior operating handle assemblies 100, 200 is operated to cause one of the release levers 610, 620 to pivot about the axis of the rivet 658 (shown in FIG. 8). As one of the release levers 610, 620 pivots about the axis of the rivet 658, its associated operating projection 676 or 678 is brought into engagement with the projection 635 on the pawl 614, causing the pawl 614 to rotate to bring the tooth formation 633 out of engagement with the abutment formations 665, 667, thereby permitting the rotary latch bolt members 602, 604 to move to their unlatched positions under the influence of the coil spring portions 690, 692.

As will be apparent from the foregoing, the present invention provides a door lock system that utilizes a novel and improved, compact and highly versatile rotary latch and connection linkage assembly that enables the system of the invention to be utilized with commercially available door lock operating and control hardware of a wide variety of forms, and with the hardware arranged in a wide variety of orientations, as may be appropriate for use with a particular door structure.

Although the invention has been described in its preferred form with a certain degree of particularity, it is understood that the present disclosure of the preferred form has been made only by way of example and that numerous changes in the details of construction may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A door lock system for a vehicle door that closes an access opening of a vehicle body for securely latching the door in a closed position, and for locking the closed latched door, the system comprising:

a) striker means including a striker member for attachment to a vehicle body at a striker location near an access opening of the vehicle body that is closable by a door of the vehicle;

b) rotary patch means including a rotary latch unit having a body for attachment to the vehicle door at a latch location for rendering the door "latched" as by latchingly engaging the rotary latch unit with the striker member for securely latching the vehicle door in a closed position, with the latch location being substantially adjacent the striker location when the vehicle door is closed, and with the rotary latch unit latchingly engaging the striker member when the door is closed;

c) the rotary latch means further including a pair of first and second pivotal release levers that are arranged in side-by-side overlying relationship and that are mounted on the body of the rotary latch unit for pivotal movement relative to the body about a common first axis, with each of said levers being pivotal about said common first axis entirely independently of the other of the levers between a normal position and a release position, and with either of said levers being operable when in its release position to effect release of latching engagement between the rotary latch unit and the striker member so that the vehicle door can be opened;

d) latch operator means for attachment to the vehicle door, including:

i) first operator means connected to the vehicle door at a first operator location that is spaced from the latch location, with the first operator means being movable at the first operator location between a first normal position and a first latch operating position; and, ii) second operator means connected to the vehicle door at a second operator location that is spaced from the latch location and from the first operator location, with the second operator means being movable at the second operator location between a second normal position and a second latch operating position;

e) connection means for establishing a driving connection between the latch operator means and the rotary latch means to normally enable the latch operator means to "unlatch" the door as by releasing the rotary latch unit from latchingly engaging the striker member and to thereby enable the vehicle door to be moved from its closed position, the connection means including:

i) first linkage means including a pair of elongate links that each extend along a portion of a first path that extends from the first operator location to the latch location, with one of the elongate links of the first linkage means being drivingly connected to the first operator means at the first operator location, with the other of the elongate links of the first linkage means being drivingly connected to the first pivotal release lever of the rotary latch unit t the latch location, and with said one link and said other link being operable when drivingly connected one-to-the-other to establish a driving connection that extends along the first path for enabling the first operator means to unlatch the door s by causing the first pivotal release lever of the rotary latch means to be pivoted about the common first axis from its normal position to its release position to cause the rotary latch unit to release its latching engagement with the striker member and to thereby unlatch the door in response to movement of the first operator means from the first normal position to the first latch operator position; and, ii) second linkage means that extends along a second path from the second operator location to the latch location, with the second linkage means being drivingly connected to the second operator means at the second operator location and to the second pivotal release lever of the rotary latch unit at the latch location for establishing a driving connection that extends along the second path for enabling the second operator means to unlatch the door as by causing the second pivotal release lever of the rotary latch means to be pivoted about the common first axis from its normal position to its release position to cause the rotary latch unit to release its latching engagement with the striker member and to thereby unlatch the door in response to movement of the second operator means from the second normal position to the second latch operator position;

f) lock control means including a lock control unit that is connected to the vehicle door at a lock control unit location that lies along the first path at spaced distances from the latch location and the first operator location, with the lock control means being operable to selectively disable and enable the driving connection that is provided by the first linkage means between the first operator means and the rotary latch unit when the door is latched and to thereby "lock" the closed latched door against being unlatched;

g) first control means for operating the lock control means including a first control member connected to the vehicle door and residing at a first control member location that is spaced from the lock control unit location, and first control member linkage means for connecting the first control member to the lock control unit for operating the lock control unit in response to movement of the first control member between locked and unlocked positions to selectively permit and prevent the establishment of a driving connection between said one link and said other link of said first linkage means so as to selectively permit and prevent the establishment of a driving connection between the first operator means and the rotary latch unit when the door is latched, with the first control means serving to disable said driving connection when the first control member is in its locked position, and serving to enable said driving connection when the first control member is in its unlocked position;

h) the first linkage means being connected to the first release lever for pivoting the first release lever about said common first axis from its normal position to its release position for effecting unlatching of the rotary latch unit in response to movement of the first operator means from its first normal position to its first latch operating position at a time when said first control means is operative to enable said driving connection;

i) the second linkage means being connected to the second release lever for pivoting the second release lever about said common first axis from its normal position to its release position for effecting unlatching of the rotary latch unit in response to movement of the second operator means from its second normal position to its second latch operating position; and, j) the lock control means including a second pair of first and second coupler levers that are arranged in side-by-side overlying relationship and that are mounted for pivotal movement about a common second axis, with each of said coupler levers being pivotal about said common second axis between a normal position and an operating position, and with the coupler levers normally being drivingly connected by coupler means for concurrent movement about said common second axis so as to drivingly connect said one link and said other link of said first linkage means, but also being cooperative with the coupler means to selectively disrupt the normal driving connection between said one link and said other link of said first linkage means to thereby selectively prevent the first linkage means from enabling the first operator means to unlatch the rotary latch means from latching engagement with the striker means, with one of the coupler levers being connected to said one link of said first linkage means, and with the other of the coupler levers being connected to said other link of said first linkage means, and with the coupler means being movable relative to the coupler levers between i) a connecting position wherein the coupler means is operable to drivingly connect the one and other links of the first linkage means for concurrent movement so that movement of either one of said one link and said other link of said first linkage means will result in corresponding movement of the remaining one of said one link and said other link of said first linkage means, and ii) a disconnecting position wherein the coupler means is operable to drivingly disconnect said one link and said other link of said first linkage means so that movement of either one of the linkage elements of said one link and said other link of said first linkage means will not result in corresponding movement of the remaining one of said one link and said other link of said first linkage means, and whereby the first operator means will be disabled from effecting unlatching engagement between the rotary latch unit and the striker member.

2. The door lock system of claim 1 additionally including coupler support means for connecting said coupler means to the vehicle door while, at the same time, mounting the coupler means for movement relative to said second pair of first and second coupler levers between said disconnecting and connecting positions.

3. The door lock system of claim 2 wherein the first control member is a sill button that is movable between locked and unlocked positions from an interior side of the vehicle door to effect movement of the coupler means between its disconnecting and connecting positions.

4. The door lock system of claim 2 wherein the first control member is a key operated lock that is operable from an exterior side of the vehicle door to effect movement of the coupler means between its disconnecting and connecting positions.

5. The door lock system of claim 1 additionally comprising second control means including a second control member connected to the vehicle door and residing at a second control member location that is spaced from the location of the lock control unit location, and second control member linkage means for connecting the second control member to the lock control unit for operating the lock control unit in response to movement of either of the first and second control members to effect movement of the first connection means between locked and unlocked positions.

6. The door lock system of claim 5 wherein the first control member is a key operated lock that is operable from an exterior side of the vehicle door.

7. The door lock system of claim 6 wherein the second control member is a sill button that is movable between locked and unlocked positions from an interior side of the vehicle door.

8. The door lock system of claim 1 wherein the second pair of first and second coupler levers include non-identically configured but alignable slot formations that are formed in the coupler levers, and the coupler means includes connection pin means extending through said slot formations, and the first control means is operable to move the connection pin means relative to said slot formations between said connecting position wherein the connection pin means serves to establish a driving connection that assures concurrent pivotal movement of the coupler levers about the common second axis, and said disconnecting position wherein the connection pin means provides no such driving connection between the coupler levers.

9. The door lock system of claim 1 wherein the first operator means includes an internal door handle operating assembly that is operable from an internal side of the door to unlatch the door.

10. The door lock system of claim 1 wherein the second operator means includes an external door handle operating assembly that is operable from an external side of the door to unlatch the door.

11. The door lock system of claim 1 wherein:

a) the body of the rotary latch means includes structure defining a notch into which the body portion of the striker means is admitted as the door is closed;

b) first and second bolt members are pivotally supported by the body at spaced locations on opposite sides of the notch for movement between latching and unlatching positions;

c) each of the bolt members is provided with:

i) a recess formation facing generally toward the notch for receiving and engaging the striker means when the striker means is admitted to the notch; and, ii) a cam surface which cooperates with the cam surface on the other of the bolt members for assisting to effect concurrent movement of the bolt members between their latching and unlatching positions;

d) the recess formations are configured such that, when the bolt members are in their unlatching positions, the striker means may be moved into and out of the notch, and such that when the striker means is received in the recess formations with the bolt members in their latching positions, the striker means is retained in the notch by the bolt members;

e) first biasing means is provided for biasing the bolt members toward their unlatching positions;

f) one of the bolt members has at least one abutment formation thereon;

g) a pawl movably carried on the body means and has tooth means which is engageable with the abutment formation for preventing unlatching movement of the bolt members;

h) second biasing means is provided for biasing the tooth means into engagement with the abutment formation when the bolt members are moved to their latching positions;

i) the first and second release levers each are operable to move the pawl in opposition to the second biasing means to release the tooth means from engagement with the abutment formation to permit the bolt members to move under the influence of the first biasing means toward their unlatching positions to release the striker means; and, j) the bolt members are provided with stop formations configured to engage each other when the bolt members are in their latching positions to prevent further rotation of the bolt members in directions away from their unlatching positions, and to thereby positively prevent the bolt members from becoming inoperably jammed together.

12. The latch-type fastener means of claim 11 wherein the recess formations are configured to close toward the striker means as the striker means is moved into the notch and as the bolt members move concurrently toward their latching positions.

13. The latch-type fastener means of claim 12 wherein the recess formations are configured such that, as they close toward each other, they serve to center the striker means with respect to opposite sides of the notch, whereby, when the bolt members are in their latching positions, they hold the striker means at a predetermined centered location out of engagement with such portions of the housing structure as define the notch.

14. The latch-type fastener mechanism of claim 12 wherein the body of the rotary latch unit is formed as an assembly including a pair of side plates, three parallel oriented bushings positioned at spaced locations between the side plates.

15. The latch-type fastener mechanism of claim 14 wherein each of the bolt members is journaled on a separate one of the bushings, and the pawl is journaled on the remaining one of the bushings.

* * * * *